United States Patent [19]

Brewer

[11] 4,125,228

[45] Nov. 14, 1978

[54] SHREDDER AND IMPROVEMENTS THEREIN

[75] Inventor: John C. Brewer, Salt Lake City, Utah

[73] Assignee: Garbalizer Corporation of America, Salt Lake City, Utah

[21] Appl. No.: 842,957

[22] Filed: Oct. 17, 1977

[51] Int. Cl.[2] ..... B02C 18/16

[52] U.S. Cl. ..... 241/243; 83/356.3; 83/698

[58] Field of Search ..... 241/190, 243, 291, 300; 83/355, 356.3, 698, 906

[56] References Cited

U.S. PATENT DOCUMENTS

| | | | |
|---|---|---|---|
| 3,202,369 | 8/1965 | Judd | 241/190 |
| 3,244,049 | 4/1966 | Smith et al. | 83/355 |
| 3,893,635 | 7/1975 | Brewer | 241/243 |
| 4,015,782 | 4/1977 | Granite | 241/243 X |
| 4,059,236 | 11/1977 | Brewer | 241/243 |

*Primary Examiner*—Howard N. Goldberg

[57] ABSTRACT

A shredder comprising a rotor and stationary structure. The rotor includes a shaft provided with a series of grooves and split blades mounted within said grooves, this by attachment means penetrating the shaft. The fixed structure forms an anvil or reaction structure having a series of independently removable, supported, upright transverse support blocks having hardened metal segments provided with upper cutting or shearing edges. The anvil structure includes an elongate cutter bar forming, with the cutting edges of said segments, a U-shape groove through which the individual blades pass. All of the hardened-metal, and preferably tempered steel cutting segments are completely supported by the fixed support structure and are usually independently and individually replaceable as may be needed through the operation of the machine. Ramp-providing rib structures are provided and are likewise split construction for easy removal from the interior hopper area of the shredder.

6 Claims, 5 Drawing Figures

SHREDDER AND IMPROVEMENTS THEREIN

FIELD OF INVENTION

The present invention relates to shredders and, more particularly to shredder mechanisms provided with revolving shafts having a series of blades mounted thereon, within the grooves thereof, and also fixed anvil or reaction structure wherein the interior area is open and the shearing edge structure is individually replaceable, together with their individual removable supports.

BACKGROUND AND DESCRIPTION OF PRIOR ART

Shredders, of course, are not new. Many of the inventor's prior patents have disclosed various types of shredders for the purpose of reducing municipal and industrial waste, tires, timber, and so forth. As to the rotor of the shredder, it has been suggested previously the collars and bushings be employed for the blades or, as in the case of the U.S. Pat. No. 4,082,232 entitled "SHREDDER STRUCTURE AND IMPROVEMENTS THEREIN," that the shaft be economically grooved and the blades seated within such grooves.

It has been found that the present invention clearly reduces the cost of providing shafts having split blades. The blades, of course, must necessarily be split herein, and the individual segments are actually bolted or otherwise attached directly to the shaft. This supplies both ease of construction and reduction of manufacturing expense, as well as providing a highly effective revolving blade construction.

Prior patents have also taught various types of reaction means or anvil structures. None of those of which the inventor is aware teaches both the concept of providing an open interior beneath the rotor such that the reaction or cutter bars stop short of the central area of the shredder, and also that the individual cutter bar segments with their upright support blocks are both independently removable and replaceable and also supported from underneath the same by primary support means. Various patents are known as below delineated but none of these teach the important concept of securing blades as by threaded bolt means to a shaft at a point registering with the grooves inner surfaces and also providing stationary shredding or shearing structure wherein supported upright blocks or their equipment are individually removable and replaceable and provided with removable and replaceable cutter bar segments.

U.S. Pat. Nos. 1,419,407 1,444,035 2,552,166 2,919,075 2,973,979 3,159,047 3,578,252 3,845,907 3,893,635 3,931,935 3,951,346

BRIEF DESCRIPTION OF THE INVENTION

According to the present invention, the rotor herein comprises an elongate shaft of circular cross-section having a series of mutually spaced grooves which receive split blade structures. The individual segments of this split blade, e.g., the blade halves, are individually bolted or otherwise secured directly to the shaft, by the provision of threaded apertures passing radially into the shaft approximately 2 inches or so in depth, for example. The blades are preferably chosen to be opposite halves and identical, for ease of fabrication and reduction of fabrication expense. The individual blade segments are keyed by appropriate means to the shaft and, preferably, are helically oriented about the shaft for ease of cutting. The fixed structures includes a succession of fixed split ramps over which incoming material slide into the cutting area of the machine. The cutting or operating area of the fixed structure has a series of upright support blocks which are supported by prime support structure and, in addition, which carry hardened metal segments for shearing purposes. An additional hardened metal segment or cutter bar is disposed essentially parallel to the rotor shaft and forms with the block segments a series of shearing U's by which the incoming debris may be appropriately reduced, and sheared.

OBJECTS

Accordingly, a principal object of the present invention is to provide a new and improved shredder.

A further object is to provide an improved rotor in a shredder wherein a grooved shaft incorporates a series of split blades, the blade segments themselves being secured directly to the shaft as by attachment means, preferably bolts threaded into the shaft.

A further object is to provide a shredder having an anvil or cutter bar structure wherein the blocks thereof supporting the fixed cutter bar segments are themselves supported and individually removable and replaceable, should the machine malfunction or overload.

A further object is to provide an improved anvil structure for shredders.

A further object is to provide a shredder of substantially reduced manufacturing and assembling costs.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

DESCRIPTION OF PREFERRED EMBODIMENTS

Figures 1, 2, 3, 4, 5:
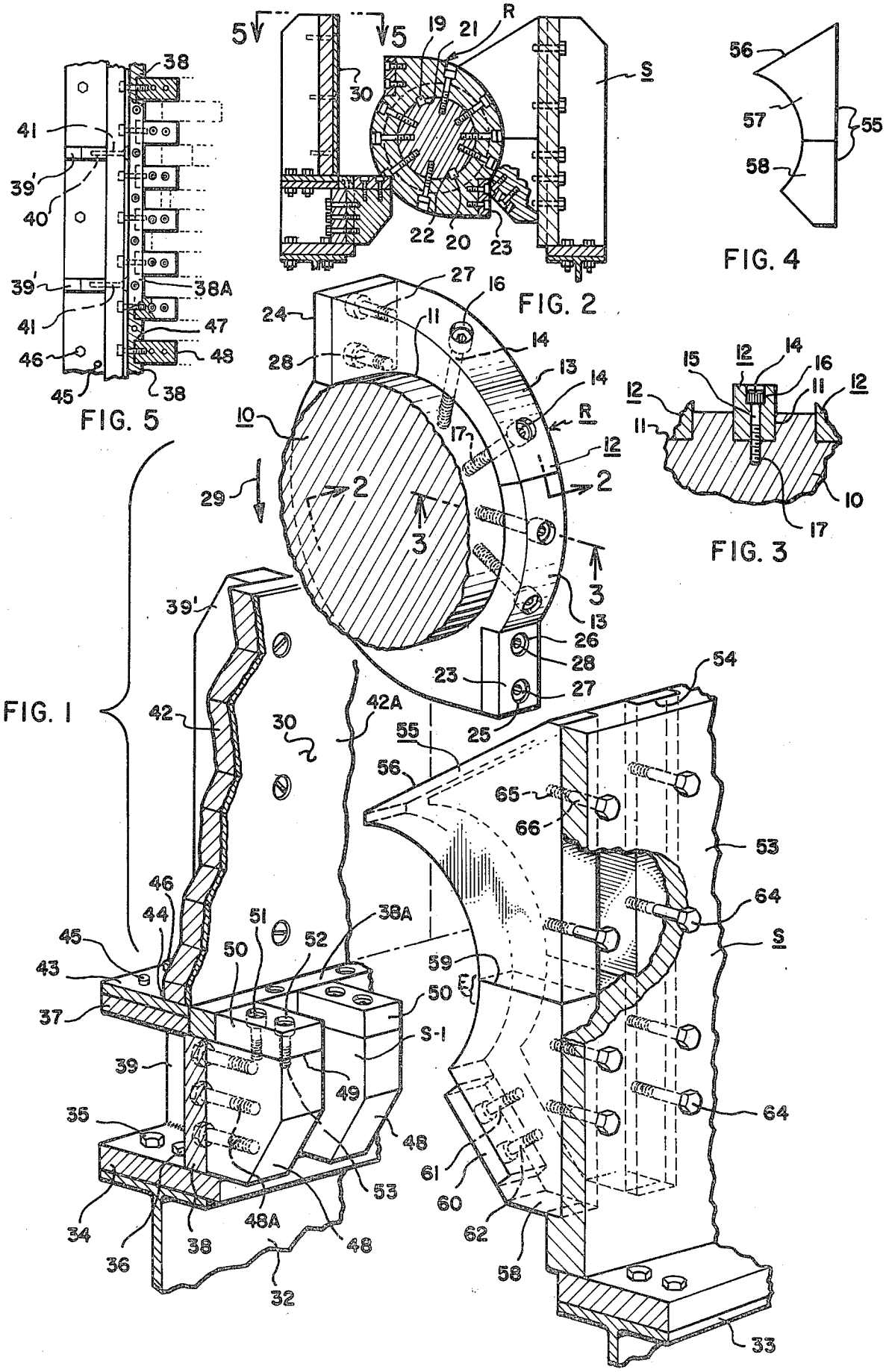
FIG. 1 is an exploded, fragmentary, perspective view of shredder structure constructed in accordance with the principles of the invention, in one embodiment thereof.
FIG. 2 is a transverse vertical cross-section of the structure of FIG. 1 when assembled, and is taken along line 2—2.
FIG. 3 is an enlarged fragmentary section taken along the line 3—3 in FIG. 1, of a shaft portion indicating the structure by which the individual split blades are secured to the shaft.
FIG. 4 is a side elevation and reduced in scale of the rib halves or elements constituting the rib means of FIG. 1.
FIG. 5 is a plan view taken along the arrow 5—5 in FIG. 2 of certain stationary structure at the left of FIG. 2.

In FIG. 1 the shaft 10 of rotor R includes a series of transverse, essentially annular grooves 11, see FIG. 3, which individually receive a respective split blade 12. Each split blade comprises, preferably, identical blade segments 13, for reduction in expense in manufacture, such blade segments, two in number for example as seen in FIG. 1, being secured directly to the shaft 10 by means of attachment means 14. This attachment means preferably comprises threaded, headed attachments such as bolts; thus, apertures 15 and 16 are provided at several places at each blade segment, this to accommodate attachmemt access such that the latter may be threaded into threaded holes or apertures 17 of the shaft. The individual split blades may be interiorly tapered to fit into a tapered shaft recess, it desired; in the embodiment shown, the grooves are straight or essentially so.

Keys 19 and 20 key each blade segment to the shaft, the shaft being comprised with keying grooves 21,22, which at their successive places relative to successive blades, will preferably be disclosed in a helical pattern about the shaft such that the cutting edges of the split blades are mutually disposed along an essentially helix-type locus of points.

Each blade segment will include a hardened metal segment such as a hardened steel segment 23,24, which respectively are provided with counter-board apertures 25 and 26 receiving Allen screws or other headed attachments 27 and 28 threaded into the respective blade segments. Accordingly, the shaft, with its series of split blades as at 12, will revolve in a counter-clockwise direction as shown by the arrow 29, in the embodiments shown, to reduce the material received in hopper opening 30 in FIG. 2.

The main advantage of the rotor R comprising shaft 10 with its series of split blades 12, one being shown in FIG. 1, is that the shaft is very inexpensive in that the grooves can be simply machined to accommodate the several blades. The blades themselves are fixedly disposed with respect to each other and to their respective blade segments, simply by the bolt attachments employed as by bolts 14, for example. Thus, collars, spacers, and the like can be completely eliminated from the rotor structure.

Attention is now turned to the fixed structure of the apparatus, see again FIG. 1 in combination with FIGS. 2,4 and 5. Stationary I-beams 32 and 33 are provided and supported by external structure, not shown. I-beam 32 includes a base support plate 34 that is provided with bolt and nut attachments at 35 and 36. Base and upper support plates 34 and 37 are welded to a horizontally elongate upright support 38, the two being provided with a series of blocks at 39. Aligned ribs 39' may include drilled and tapped apertures 40 receiving the attachments 41 that secure side plate 42 and hopper liner 42A. Side plate 42 and base plate 43 may be welded together at 44 and provide structure suitable for securement to the welded-together structure including members and plates at 38, 34 and 37 by virtue of bolts 46 and dowel pins 45. The base support plate 43 is supported by plate 37 and is anchored and aligned therewith by means of attachments 46 and dowel pins 45. Upright support 38 is recessed with a series of recesses 47 to provide for the reception of a series of respective upright support blocks 48, bolted to support 38 by bolts 48A. The support blocks include at the upper surfaces 49 a hardened metal cutter bar segment 50 for shearing purposes. Cutter bar segments 50, with bar 38A, form U's at S-1 as can be seen in FIG. 1. The series of hardened metal segments 50 are provided with headed attachments 51 that are respectively recessed in counterbored areas 52 so that the attachments may thread into the threaded apertures 53 of the several upright support blocks 48. At the remaining right-hand side of the shredder S there is provided a side plate 53 that has a series of mutually spaced vertical recesses or grooves 54 into which fit a series of rib means 55 having downwardly canting sloping edges 56. Each of the rib means 55, aligned with blocks 48, is made up of upper and lower rib halves or segments 57 and 58 which join together at a juncture 59 and define a concave composite edge E. The lower rib half is provided with a hardened metal insert or blade 60 that includes a series of recessed attachments 61 in counterbored area 62, for attachment to the lower rib half. Bolts 64 are threaded into threaded apertures 65 of each of the rib halves, this via a communication and penetration through apertures 66 of side plate 53, so that the ribs proceed inwardly proximate the shaft area and between the split blades 12 of the shaft 10. the canted surfaces 56 serve as respective slide ramps for incoming material such that the material may fall into essentially solely the lefthand portion of hopper 30 as seen in FIG. 2. Blade 60 serves to shear or wipe off materials that cling to rising blade segments.

The structure operates as follows. At the outset it is seen and has been previously described that the shaft 10 will include a plurality of split blades mounted in the grooves 11 thereof. Accordingly, there will be a series or a succession of upright support blocks 48, two being shown in FIG. 1, wherein the blades in their revolvement will be aligned with and pass through the slots S-1 between the adjacent upright support blocks with their hardened metal segments at their upper surfaces 49. The grooving of the upright support 38 as before-mentioned will aid in an accurate spacing between the upright support blocks to exactly receive the revolving split blade aligned with slot S-1. It is seen that ample support is provided by the base support plate 34 for the individual hardened segments and the support blocks before mentioned. Accordingly, a very inexpensive and yet a completely rigid structure is provided by virtue of that shown and described with respect to the lower left-hand portion at FIG. 1.

The rib means comprising the two rib halves or segments as at 57 and 58, serve to insure that the rib means encompasses a peripheral portion of the shaft so that hardened segment 60 is based close enough to the revolving blade to be effective in its wiping and shearing function.

Accordingly, what is presented is a new, useful and improved shredder structure for shredding imcoming materials, these such materials municipal or industrial waste, tires, timber, metal products, household wastes and so forth; importantly, the central portion of the hopper proximate the shearing structure is open, allowing for free passage of materials where the same have descended down the edges 56 to the cutting area proximate stationary segments 50. The revolving split blades serve to shear the materials, the blades passing through slots S-1 between adjacent upright support blocks 48, whatever number the latter may be employed.

Importantly, where the upright support blocks 48 are independent and bolted, then these may be very quickly replaced individually, should damage occur to the support block. Additionally, the elongate bar at 38A which is hardened and also effects an end cutting or shearing operation, rests exactly upon the upright support 38 supported in turn by I-beam 32. This offers a maximum of support, to and by fixed structure, for accurately placing the elongate bar at 38A, being sure that the same is properly supported for end shear cuts. Thus, the split blades with their blade segments 24 in FIG. 1 pass through a U-type slot S-1 for making a very accurate U-shape cut completely about the part being sheared. This optimizes the operation advantages of the machine. It is noted that where the rib means 55 is split as indicated, that either half may be replaced without disassembling the other, and this without removing the shaft or any part of the rotor structure.

What is provided therefor is a highly efficient and very economical shredder machine for shredding a variety of materials as above mentioned.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. In a shredder having a feed opening, an axially revolvable rotor comprising a shaft provided with a series of mutually spaced blade means, and fixed structure cooperatively disposed with respect to said rotor: an improvement wherein said fixed structure includes a rigidly supported horizontal base plate, a horizontally elongate, upright support having a series of upright grooves and transverse apertures contiguous with said grooves, the spacing between said grooves being essentially, respectively aligned with said blade means of said rotor, a plurality of upstanding blocks resting on and supported by said base plate and positioned in said grooves of said upright support, said upstanding blocks having apertures mutually registering with said transverse apertures of said upright support, and plural attachment means passing through said registering apertures for releasably securing said upstanding blocks at said apertures thereof to said upright support.

2. The structure of claim 1 wherein said blocks individually include uppermost, releasably attached cutter bar segments coacting with said blade means for shredding material temporarily positioned between said blade means in their revolvement, and said cutter bar segments.

3. The structure of claim 2 wherein said upright support includes an upper, hardened-metal, horizontal, elongate, cutting bar contiguous with and forming cutting U's with respect to said cutter bar segments.

4. The structure of claim 1 wherein said fixed structure is provided with rib means spaced from said blocks, mutually spaced apart to provide blade passage, and comprising plural rib segments bolted proximate each other and defining a juncture proximately aligned with said shaft.

5. The structure of claim 4 wherein said rib segments have cooperating inner edges defining a concave composite edge disposed proximate said shaft.

6. The structure of claim 4 wherein a lower one of said rib segments has an essentially downwardly facing operative bar segment.

* * * * *